US006986394B2

(12) United States Patent
Marsh

(10) Patent No.: US 6,986,394 B2
(45) Date of Patent: Jan. 17, 2006

(54) RECIPROCABLE IMPACT HAMMER

(75) Inventor: Brent Marsh, Boumemouth (GB)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/834,228

(22) Filed: Apr. 29, 2004

(65) Prior Publication Data

US 2005/0241842 A1 Nov. 3, 2005

(51) Int. Cl.
*B23Q 5/027* (2006.01)

(52) U.S. Cl. ..... 173/13; 173/141

(58) Field of Classification Search ..... 173/73, 173/91, 131, 137, 125, 13, 141; 175/293, 175/296, 299
See application file for complete search history.

(56) References Cited

U.S. PATENT DOCUMENTS 2,813,516 A * 11/1957 Dulaney ..... 173/73
2,988,417 A * 6/1961 Emmons et al. ..... 8/116.1
3,946,819 A * 3/1976 Hipp ..... 175/296
5,131,476 A * 7/1992 Harrington ..... 173/17
5,139,094 A * 8/1992 Prevedel et al. ..... 175/61
5,156,223 A 10/1992 Hipp
5,293,959 A * 3/1994 Kimberlin ..... 184/6.14
5,305,837 A * 4/1994 Johns et al. ..... 175/61
5,322,136 A 6/1994 Bui et al.
5,339,913 A * 8/1994 Rives ..... 175/73
5,564,510 A * 10/1996 Walter ..... 175/296
6,164,393 A * 12/2000 Bakke ..... 175/296
6,209,666 B1 * 4/2001 Beccu et al. ..... 175/296
6,315,063 B1 11/2001 Martini
6,609,577 B2 * 8/2003 Beccu ..... 173/93.6

* cited by examiner

*Primary Examiner*—Louis K. Huynh
*Assistant Examiner*—Nathaniel Chukwurah
(74) *Attorney, Agent, or Firm*—Finnegan, Henderson, Farabow, Garrett & Dunner LLP

(57) ABSTRACT

In the field of borehole creation there is a need for a reciprocable impact hammer with a tool that is rotatable while under load. A reciprocable impact hammer (10) for use in a downhole location comprises a tool support member (11); a hammer member (12); a jack mechanism (13); a connector member (14); and a transmission (16). The transmission (16) converts linear motion of the connector member (14) to rotary motion of the hammer member (12) whereby when a force acts on the connector member (14) via the hammer member (12) and the tool support member (11) operation of the jack mechanism (13) causes initial elongation of the impact hammer (10) followed in succession by:

(i) collapsing of the hammer member (12) and the tool support member (11) together such that the hammer member (12) separates from the connector member (14) and imparts an impulse to the tool support member (11); and (ii) movement of the connector member (14) towards the hammer member (12) under the influence of the force whereby the transmission (16) causes rotation of the remainder of the impact hammer (10).

11 Claims, 5 Drawing Sheets

56
14
16
12
10
13
28
18
11
34,35
29
19

RECIPROCABLE IMPACT HAMMER

DESCRIPTION OF THE INVENTION

Background of the Invention

The invention relates to a reciprocable impact hammer and more particularly to an impact hammer the tool support member of which is rotatable while under load.

Such a hammer is useable in operations aimed at creating, enlarging or otherwise working on a borehole.

Most commonly the need to carry out such operations arises in the oil and gas industries. In these industries it is very common to sink many boreholes, for purposes including but not limited to:

geological and formation fluid sample acquisition;

downhole data logging and/or processing; and oil and/or gas production.

Boreholes are also commonly sunk in other industries. Examples include but are not limited to:

the acquisition of subterranean mineral samples in e.g. coal and other mining industries;

downhole data logging in non-hydrocarbon bearing formations such as coal fields; and the testing and/or productionisation of water wells and aquifiers.

The invention is broadly applicable in all such industries as aforesaid; although it is of particular utility in the oil and gas exploration and production industries.

Impact hammers are used for cleaning out, re-shaping or reaming well conduits, or for making a new hole in a well. Various designs exist, all of which operate by driving a heavy downhole member against a force; and subsequently releasing the member so that the force drives it rapidly to strike a further member. The resulting impulse may cause a range of desired effects at a downhole location.

The heavy member typically is arranged to reciprocate so as to provide repeated impulses.

In oil drilling and other well operations, operators may use coiled tubing for raising and lowering tools into a well bore. The operators attach a tool/work string to the end of a reel of coiled tubing coiled around a large diameter reel at a surface location. By paying out the coiled tubing from the reel the operators can insert the tool/work string to a desired depth in the well which may be tens of thousands of feet from the surface location. By retracting the coiled tubing the operators remove the tool/work string from the well supported on the coiled tubing.

Coiled tubing is hollow along its entire length. Therefore through the use of coiled tubing it is possible to supply pressurised fluids to downhole locations. This can be for various purposes, one of which is to provide fluid to actuate or power any of various tools forming part of the tool string.

It is also known to use other types of fluid supply lines, e.g. jointed tubing in a wellbore.

Conventional drill bits and other rotary tools are not suitable for use with either coiled or jointed tubing. This is because in use such tools create torsional stresses that might damage or disconnect the tubing. Also it is impractical to rotate a string formed from many thousands of feet of coiled or jointed tubing.

Consequently the reciprocal, percussion-type tools as described above, that are powered by pressurized fluids supplied via the supply line, have been developed.

U.S. Pat. No. 5,156,223 discloses an impact hammer arrangement in which a drill bit rotates between impacts. The U.S. Pat. No. 5,156,223 arrangement utilizes the weight of the tool string to rotate the drill bit via a pin and helical track arrangement. Rotation of the tool takes place while the drill bit is unloaded.

The purpose of the rotation in the U.S. Pat. No. 5,156,223 arrangement is to prevent imprinting on the drilling surface.

The arrangement disclosed in U.S. Pat. No. 5,156,223 is not intended to rotate the drill bit while it is under load.

U.S. Pat. No. 3,946,819, U.S. Pat. No. 5,803,182 and U.S. Pat. No. 6,164,393 each disclose a reciprocal, percussion-type hammer tool that operates in response to fluid pressure communicated through a fluid supply line. Neither U.S. Pat. No. 3,946,819, U.S. Pat. No. 5,803,182 or U.S. Pat. No. 6,164,393 mention rotation of a hammer member or drill bit.

SUMMARY OF THE INVENTION

According to the invention there is provided a reciprocal impact hammer for use in a downhole location comprising:

a tool support member;

a hammer member;

a jack mechanism;

a connector member; and a transmission, wherein the tool support member and the connector member are in spaced apart relation from one another and secured to the hammer member;

the tool support member and the hammer member are moveably captive one relative to the other;

the jack mechanism operatively interconnects the tool support member and the hammer member whereby operation of the jack mechanism causes limited separation of the hammer member and the tool support member one relative to the other;

the jack mechanism is reversible to permit subsequent collapsing of the hammer member and the tool support member together;

the connector member and the hammer member are moveably captive one relative to the other;

the transmission operatively interconnects the connector member and the hammer member; and the transmission converts linear motion of the connector member to rotary motion of the hammer member whereby when a force acts on the connector member via the hammer member and the tool support member operation of the jack mechanism causes initial elongation of the impact hammer followed in succession by:

(i) collapsing of the hammer member and the tool support member together such that the hammer member separates from the connector member and imparts an impulse to the tool support member; and (ii) movement of the connector member towards the hammer member under the influence of the force whereby the transmission causes rotation of the remainder of the impact hammer.

According to a preferred embodiment of the invention the jack mechanism includes:

a piston;

a hollow cavity;

a valve member; and a control member, the piston being located at an in-use uphole end of the tool support member;

the hollow cavity being located within the hammer member;

the valve member being located adjacent to an in-use uphole end of the hollow cavity; and the control member being moveable within the hollow cavity between a first position in engagement with the piston and a second position in engagement with the valve member, whereby to control the flow of fluid through the hammer member.

Conveniently the hammer member includes a resilient biasing member for moving the control member towards the second position.

The valve member preferably is or includes a tappet valve.

Conveniently the impact hammer is or includes a fluted dart.

Preferably the hammer member includes an impact cap, the impact cap being located adjacent to an in-use downhole end of the hammer member.

In an alternative embodiment the hammer member includes a threaded portion adjacent to an in-use uphole end thereof.

In a further preferred embodiment the transmission includes:

a transmission body;

a first transfer member; and a second transfer member, the first and second transfer members being moveably captive one relative to the other at least partially within the transmission body;

the first transfer member converting the linear motion of the connector member to rotary motion of the second transfer member.

Conveniently, the first transfer member includes a pair of mutually engaged helical splines for converting the linear motion of the connector member to rotary motion of the second transfer member.

Preferably the second transfer member includes at least one of a freewheel clutch and a cone clutch, at least one of which operatively interconnects the first and second transfer members.

In another preferred embodiment of the invention the transmission body includes a thrust bearing interposed between the transmission body and the second transfer member.

Conveniently, the second transfer member includes a threaded portion that corresponds to the threaded portion of the hammer member, the corresponding threaded portions removably securing the hammer member and the transmission one to the other.

Preferably the connector member includes an engagement portion for connecting the impact hammer to an in-use downhole end of a fluid supply line.

Advantageously the tool support member includes a tool removeably secured to an in-use downhole end thereof.

It is an advantage of the invention to provide a reciprocable impact hammer that is capable of transmitting rotational torque to a tool support member while that tool support member is under load.

It is a further advantage of the invention that transmission of the torque takes place efficiently and without excessive wear of the hammer.

DESCRIPTION OF THE EMBODIMENTS

Figures 1A, 1B, 1C, 1D, 1E:
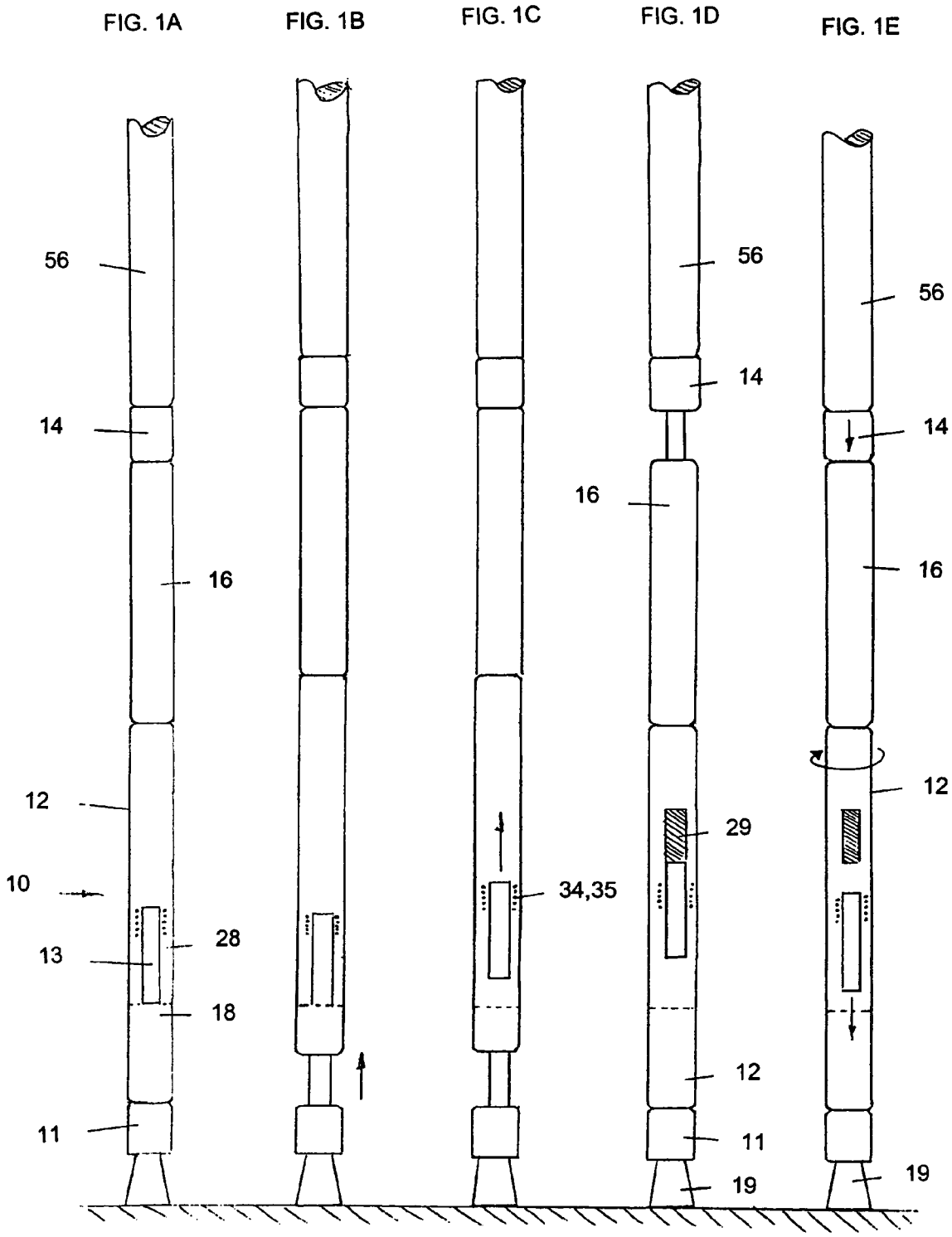
FIGS. 1A to 1E show a schematic representation of the operating sequence of an impact hammer according to an embodiment of the invention.

Referring to the drawings, a reciprocable impact hammer according to the invention is designated by the reference numeral 10. The impact hammer 10 includes a tool support member 11; a hammer member 12; a jack mechanism 13; a connector member 14; and a transmission 16 (FIG. 1A).

Figure 2:
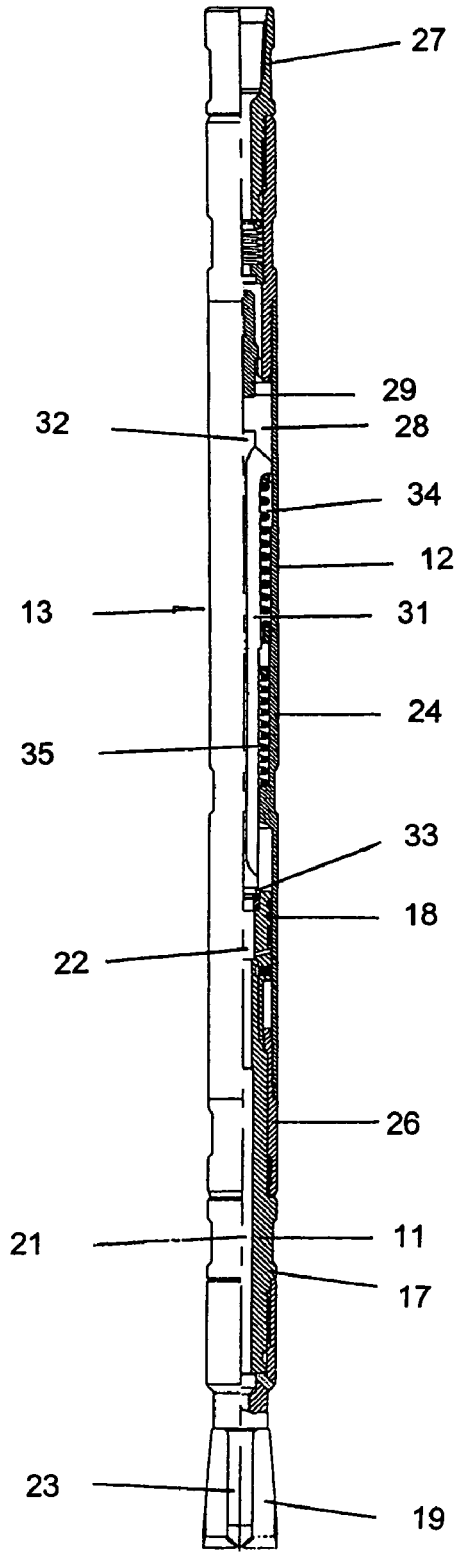
FIG. 2 is a part-sectional, elevational view of a hammer member and a tool support member according to an embodiment of the invention.

FIG. 2 shows the tool support member 11, hammer member 12, and jack mechanism 13 in more detail.

The tool support member 11 and the hammer member 12 are moveably captive one relative to the other. The jack mechanism 13 operatively interconnects the tool support member 11 and the hammer member 12.

The tool support member 11 includes an impact shaft 17 that has a substantially circular cross-sectional profile. An uphole end of the tool support member 11 defines a piston 18. A tool, e.g. a drill bit 19, is removeably connected to a downhole end of the impact shaft 17. Other types of tool may also be used.

The impact shaft 17, piston 18 and drill bit 19 each include a central, hollow cavity 21, 22, 23. The cavities 22, 23 of the piston 18 and the drill bit 19 are formed in communication with the cavity 21 of the impact shaft 17. The cavities 21, 22, 23 allow for the transmission of pressurized fluids through the impact hammer 10.

The hammer member 12 includes an elongate, hollow hammer body 24. The hammer body 24 has a substantially circular cross-sectional profile. A downhole end of the hammer body 24 has an impact cap 26 removeably secured thereto. The impact cap 26 retains the piston 18. In addition the impact cap 26 prevents the impact shaft 17 from rotating about its longitudinal axis.

An uphole end of the hammer member 12 includes a threaded portion 27.

The hammer member 12 further includes a hollow cavity 28 located therein. The hollow cavity 28 is formed in communication with the uphole end of the hammer member 12 and the piston 18 of the tool support member 11.

A tappet valve 29 is located within the hollow cavity 28, adjacent to the threaded portion 27.

A control member 31 is moveably captive within the hollow cavity 28. In the preferred embodiment the control member 31 is a fluted dart. Other types of control member are also possible.

The control member 31 includes an uphole end 32 and an downhole end 33.

Figure 6A:
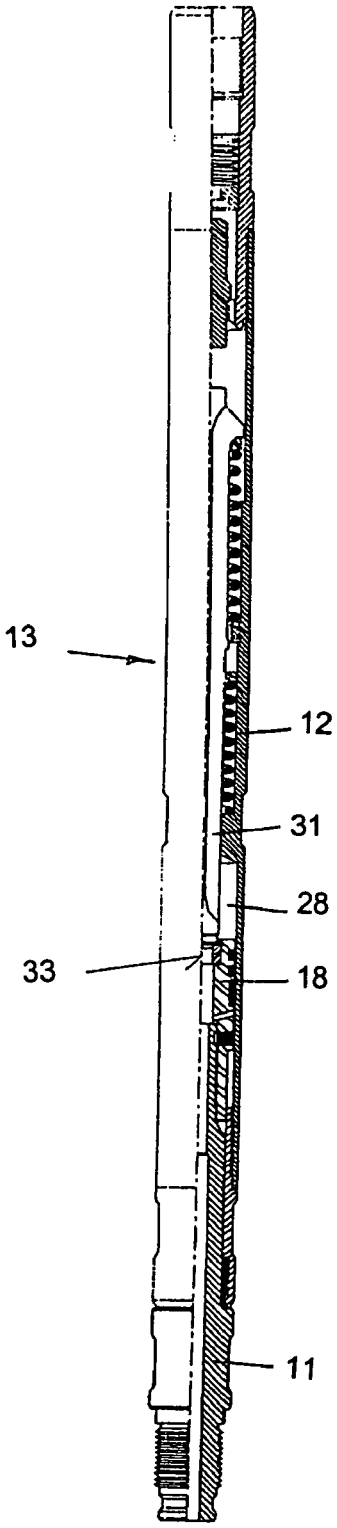
FIGS. 6A to 6D show the operating sequence of the hammer member and the tool support member shown in FIG. 2.
Figure 6B:
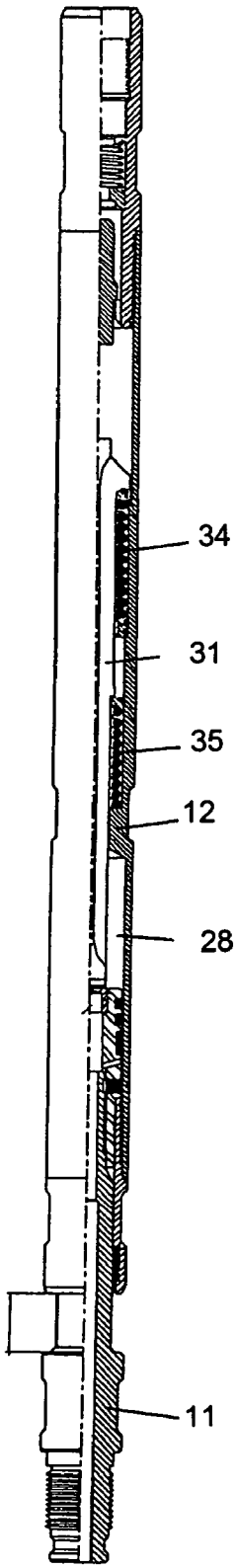
Figure 6C:
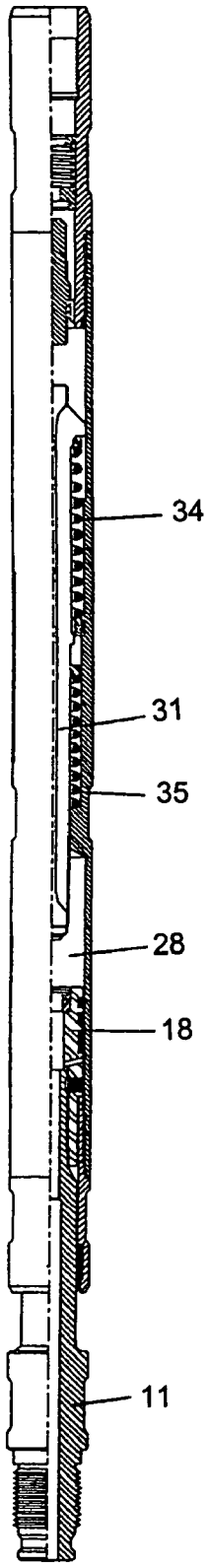
Figure 6D:
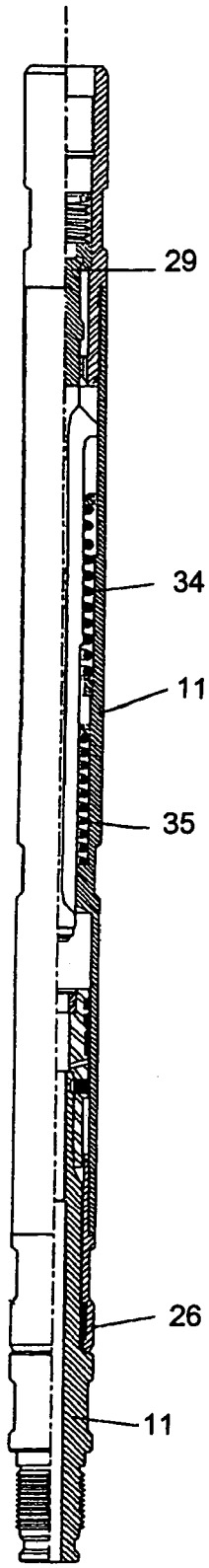

The control member 31 is moveable between a first position in contact with the piston 18 (FIGS. 2 and 6A), and a second position in contact with the tappet valve 29 (FIG. 6D).

The hammer member 12 includes at least one resilient biasing member. In the preferred embodiment the hammer member 12 includes a first coil spring 34 and a second coil spring 35.

Other types of hammer member as will be known to those of skill in the art, are also possible within the scope of the invention.

Figure 3:
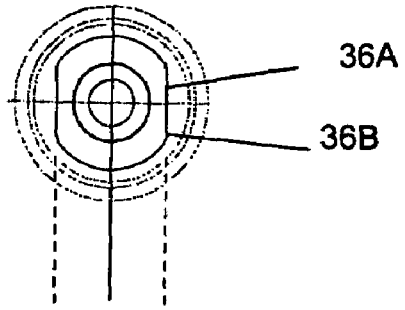
FIG. 3 is a plan view from a first end of a tool support member and a portion of a hammer member according to an embodiment of the invention.
Figure 4:
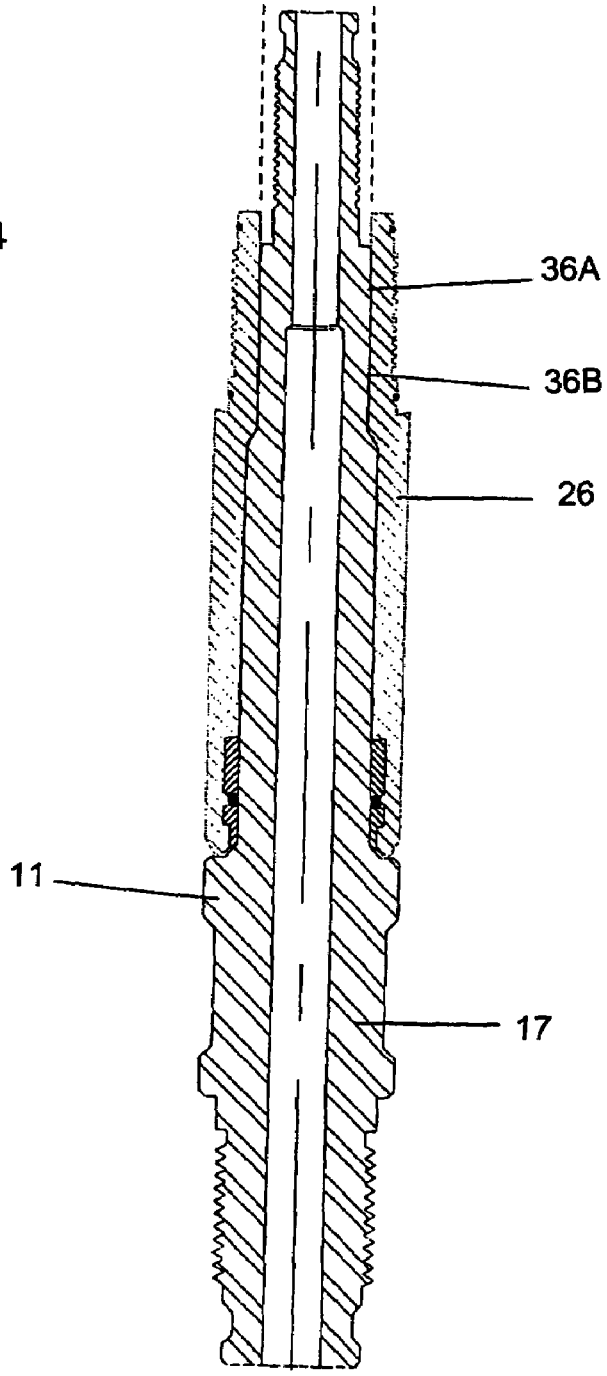
FIG. 4 is a sectional, elevation view of the tool support member and the portion of a hammer member shown in FIG. 3.

In a preferred embodiment of the impact hammer 10 the impact shaft 17 and the impact cap 26 include mutually opposable flat portions 36A, 36B (FIGS. 3 and 4).

Figure 5:
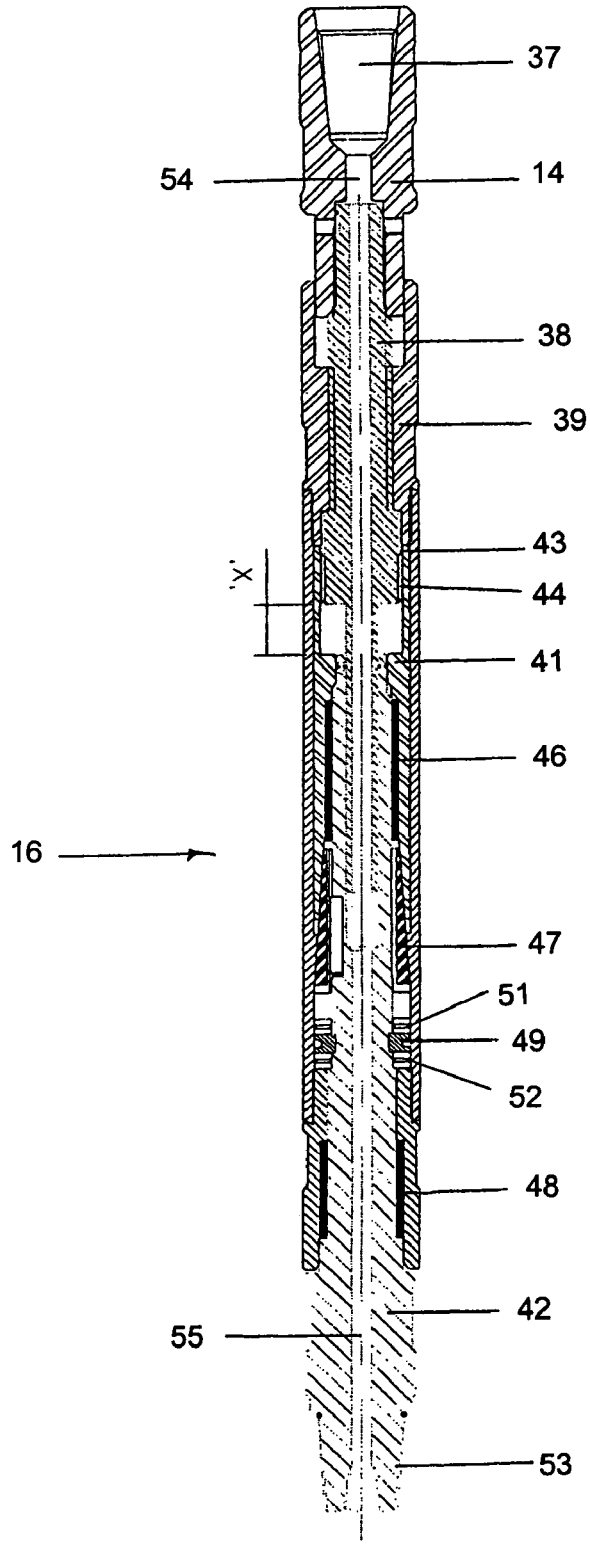
FIG. 5 is a sectional, elevational view of a connector member and transmission according to an embodiment of the invention.

FIG. 5 shows the connector member 14 and the transmission 16 in more detail.

The connector member 14 and the transmission 16 are moveably captive one relative to the other.

The connector member 14 includes a threaded portion 37 for removeably connecting the impact hammer 10 to an in-use downhole end of a fluid supply line.

The connector member also includes a first mandrel 38 having a generally circular cross-sectional profile. The first mandrel 38 is moveable within an uphole end of the transmission 16.

The transmission 16 includes a transmission body 39. The transmission body 39 has a hollow, elongate, generally tubular form.

The transmission 16 further includes a first transmission member 41 and a second transmission member 42. The first and second transmission members 41, 42 are moveably captive one relative to the other at least partially within the transmission body 39.

The first transfer member 41 includes a pair of mutually engaged helical splines 43, 44.

In the preferred embodiment the second transfer member 42 includes a first free wheel clutch 46 and a cone clutch 47 which operatively interconnect the first and second transfer members 41, 42.

The preferred embodiment also includes a second free-wheel clutch 48 interposed between the transmission body 39 and the second transfer member 42.

Other types and combinations of clutch are also possible.

The transmission includes a thrust bearing 49 interposed between the transmission body 39 and the second transfer member 42. A split ring 51, 52 is arranged adjacent to each side of the thrust bearing 49. The split rings 51, 52 hold the second transfer member moveably captive.

The in-use downhole end of the second transfer member 42 includes a threaded portion 53. The threaded portion 53 connects the transmission 16 to the hammer member 12 via the corresponding threaded portion 27 of the hammer member 12.

Both the connector member 14 and the transmission 16 include a hollow, central cavity 54, 55 formed in communication one with the other. The cavities 54, 55 permit the supply of pressurized fluids to the hammer member 12.

In use the impact hammer 10 of the invention operates as described below.

FIGS. 6A to 6D show the operating sequence of the tool support member 11; the hammer member 12; and the jack mechanism 13.

To initiate operation of the jack mechanism 13 an operator applies a so-called "set down weight" to the hammer member 12. The set down weight may typically lie in the range 500 lbs to 2,850 lbs.

Simultaneously the operator applies a fluid pressure of typically between 500 psi and 2,500 psi to the impact hammer 10 via the fluid supply line. The fluid pressure is transmitted to the control member 31 via the hollow cavity 54 in the connector member; the hollow cavity 55 in the transmission 16; and the hollow cavity 28 in the hammer member 12.

The combination of set down weight and fluid pressure causes the downhole end 33 of the control member 31 to seat against the piston 18. The seating of the control member 31 against the piston 18 prevents the discharge of fluid via the remainder of the tool support member 11, i.e. cavities 21, 22 and 23.

Consequently there is a build up of pressure in the hollow cavity 28 of the hammer member 12. This pressure increase causes limited separation of the hammer member 12 and the tool support member 11 one relative to the other.

Since the downhole end of the tool support member 11 is restrained by the bottom of the borehole, or other obstruction, the limited separation of the hammer member and the tool support member 11 has the effect of lifting the hammer member 12 in an uphole direction (FIG. 6B).

Movement of the hammer member 12 results in the compression of the first and second springs 34, 35. When the first and second springs 34, 35 are fully compressed subsequent movement of the hammer body 12 lifts the control member 31 away from the piston 18 (FIG. 6C).

Movement of the control member 31 relative to the piston 18 breaks the seal therebetween. This allows the discharge of fluid via the cavities 21, 22, 23 in the tool support member 11. As a result the fluid pressure within the hollow cavity 28 falls.

This reversing of the jack mechanism 13 permits the collapsing of the hammer member 12 and the tool support member 11 together (FIG. 6D). The collapsing occurs because of the absence of fluid pressure to lift the hammer member 12. The weight of the hammer member 12 and the transmission connected thereto causes the hammer member 12 to collapse towards the tool support member 11.

When the hammer member 12 and the tool support member 11 collapse together the hammer member 12 imparts an impulse to the tool support member 11. The impulse is transmitted via the impact cap 26 to the impact shaft 17.

The impulse drives the drill bit 19 into the drilling surface, thereby loading the drill bit 19 and the tool support member 11.

Once the control member 31 moves away from the piston 18, the first and second springs 34, 35 continue to move the control member 31 towards its second position, i.e., the tappet valve 29. When the uphole end 32 of the control member 31 engages the tappet valve 29 it closes the valve. This interrupts the flow of fluid through the hammer member 12. The resulting fall in fluid pressure in the hollow cavity 28 permits the control member 31 to return to its first position (FIG. 6A). The operating cycle then repeats.

FIGS. 1A to 1E show in schematic form the operation of a reciprocable impact hammer according to the invention in combination with a known fluid supply line 56.

FIG. 1A indicates the condition of the impact hammer 10 following the application of a set down weight to the tool support member 11.

The control member 31 becomes seated against the piston 18. The increase in fluid pressure within the hammer member 12 causes limited separation of the hammer member 12 and the tool support member 11 one relative to the other (FIG. 1B).

The separation of the hammer member 12 and the tool support member 11 has the effect of lifting the remainder of the impact hammer 10 and the fluid supply line 56 in an uphole direction.

When the control member 31 is moved away from its seated position adjacent to the piston 18 the fluid pressure in the hammer member 12 falls. The hammer member 12 and the transmission 16 then collapse towards the tool support member 11 under their own weight. The collapsing together of the hammer member 12 and the tool support member 11 imparts an impulse to the tool support member 11. The impulse drives the drill bit 19 into the drilling surface.

The drill bit 19 and tool support member 11 are now under load.

As the hammer member 12 and the transmission 16 collapse towards the tool support member 11, inertia in the fluid supply line 56 results in the hammer member 12 and transmission 16 separating from the connector member 14 (FIG. 1D).

Once the hammer member 12 and the tool support member 11 have collapsed together (FIG. 1D) the set down weight forces the fluid supply line 56 and connector member 14 secured thereto to move towards the hammer member 12. This movement causes the transmission 16 to rotate the remainder of the impact hammer 10.

In the preferred embodiment the transmission 16 operates as follows.

Linear movement of the connector member 14 towards the hammer member 12 results in the linear movement of the first mandrel 38 relative to the transmission body 39 (FIG. 5).

The mutually engaged helical splines 43, 44 convert this linear motion to rotary motion of the first transfer member 41. The mutually engaged helical splines are more robust than, e.g. a pin a helical track arrangement. In addition, the compressive and torsional loads are evenly distributed when using a pair of splines, thereby reducing the amount of wear and damage that occurs.

The first freewheel clutch 46 and the cone clutch 47 transmit the rotary motion of the first transfer member 41 to the second transfer member 42.

The first freewheel clutch 46 and the cone clutch 47 transmit rotary motion in one direction only. In the embodiment shown this direction is clockwise when viewed from the in-use uphole end of the impact hammer 10.

When the hammer member 12 and transmission 16 separate from the connector member 14 (FIG. 1D) the first freewheel clutch 47 freewheels and the cone clutch 47 disengages. As a result rotary motion of the first transfer member 41 is not transmitted to the secondary member 42, thereby helping to prevent the transmission of so-called "back-torque" to the tool support member 11.

During use of the impact hammer 10 the thrust bearing 49 transmits axial load between the second transfer member 42 and the transmission body 39. This limits the friction force acting on the second transfer member 42 during operation of the hammer 10.

A second freewheel clutch 48 is interposed between the second transfer member 42 and the transmission body 39. This helps to further reduce the transmission of back-torque to the tool support member 11.

The second transfer member 42 is removeably secured to the hammer member 12 via corresponding threaded portions 53, 27. Therefore rotary motion of the second transfer member is transmitted to the hammer member 12.

The mutually opposable flat portions 36A, 36B(FIG. 4) prevent rotation of the tool support member 11 and the hammer member 12 one relative to the other. Consequently, as the hammer member 12 rotates the tool support member 11 and the drill bit 19 rotate.

Rotation of the tool support member 11 occurs while it and the drill bit 19 are under load, thereby enabling the tool operator to control the hammer action. The tool operator controls the hammer action by during the drilling operation setting down or laying off weight on the drilling bit, as necessary.

What is claimed is:

1. A reciprocable impact hammer for use in a downhole location comprising:

a tool support member;

a hammer member;

a jack mechanism;

a connector member; and a transmission, wherein the tool support member and the connector member are in spaced apart relation from one another and each are secured to the hammer member;

the tool support member and the hammer member are moveable one relative to the other;

the jack mechanism operatively interconnects the tool support member and the hammer member whereby operation of the jack mechanism causes limited separation of the hammer member and the tool support member one relative to the other;

the jack mechanism is reversible to permit subsequent collapsing of the hammer member and the tool support member together;

the connector member and the hammer member are moveable one relative to the other;

the transmission operatively interconnects the connector member and the hammer member; and includes a transmission body, a first transfer member and a second transfer member for converting linear motion of the connector member to rotary motion of the hammer member whereby when a force acts on the connector member via the hammer member and the tool support member operation of the jack mechanism causes initial elongation of the impact hammer followed in succession by:

(i) collapsing of the hammer member and the tool support member together such that the hammer member separates from the connector member and imparts an impulse to the tool support member; and (ii) movement of the connector member towards the hammer member under the influence of the force whereby the transmission causes rotation of a remainder of the impact hammer, the second transfer member includes at least one clutch, at least one of which operatively interconnects the first and second transfer members.

2. An impact hammer according to claim 1 wherein the hammer member includes a resilient biasing member for moving the control member towards the second position.

3. An impact hammer according to claim 1 including a valve member that is or includes a tappet valve.

4. An impact hammer according to claim 1 including a control member that is or includes a fluted dart.

5. An impact hammer according to claim 1 wherein the hammer member includes an impact cap, the impact cap being located adjacent to an in-use downhole end of the hammer member.

6. An impact hammer according to claim 1 wherein the hammer member includes a threaded portion adjacent to an in-use uphole end thereof.

7. An impact hammer according to claim 1 wherein the first transfer member includes a pair of mutually engaged helical splines for converting the linear motion of the connector member to rotary motion of the second transfer member.

8. An impact hammer according to claim 1 wherein the transmission body includes a thrust bearing interposed between the transmission body and the second transfer member.

9. An impact hammer according to claim 1 wherein the second transfer member includes a threaded portion that corresponds to the threaded portion of the hammer member, the corresponding threaded portions removably securing the hammer member and the transmission one to the other.

10. An impact hammer according to claim 1 wherein the connector member includes an engagement portion for connecting the impact hammer to an in-use downhole end of a fluid supply line.

11. An impact hammer according to claim 1 wherein the tool support member includes a tool removably secured to an in-use downhole end thereof.

* * * * *